US008622147B1

(12) United States Patent
Williams et al.

(10) Patent No.: US 8,622,147 B1
(45) Date of Patent: Jan. 7, 2014

(54) SOUND BASED FIRE ALARM SYSTEM AND METHOD

(75) Inventors: Brent W. Williams, Fort Worth, TX (US); Andrew W. Stell, Aledo, TX (US); Preston N. Weintraub, Keller, TX (US)

(73) Assignee: WilliamsRDM, Inc., Fort Worth, TX (US)

( * ) Notice: Subject to any disclaimer, the term of this patent is extended or adjusted under 35 U.S.C. 154(b) by 725 days.

(21) Appl. No.: 12/836,400

(22) Filed: Jul. 14, 2010

Related U.S. Application Data

(63) Continuation-in-part of application No. 12/240,081, filed on Sep. 29, 2008, now Pat. No. 7,934,564.

(51) Int. Cl.
*A62C 3/00* (2006.01)
*A62C 37/10* (2006.01)

(52) U.S. Cl.
USPC ..... 169/65; 169/60; 169/70; 169/26; 340/522

(58) Field of Classification Search
USPC ..... 169/28, 59, 65, 43, 26, 60, 70; 340/4.37, 4.4, 825.24, 825.25, 522, 340/628
See application file for complete search history.

(56) References Cited

U.S. PATENT DOCUMENTS

| | | | | |
|---|---|---|---|---|
| 5,518,075 | A | 5/1996 | Williams | |
| 5,696,487 | A | 12/1997 | Choi | |
| 6,029,751 | A | 2/2000 | Ford et al. | |
| 6,044,913 | A * | 4/2000 | Stehling et al. | 169/65 |
| 6,105,677 | A | 8/2000 | Stager | |
| 6,215,404 | B1 | 4/2001 | Morales | |
| 6,276,461 | B1 | 8/2001 | Stager | |
| 6,819,237 | B2 | 11/2004 | Wilson et al. | |
| 7,182,143 | B2 | 2/2007 | Hall et al. | |
| 7,391,316 | B2 | 6/2008 | Albert et al. | |
| 7,429,921 | B2 | 9/2008 | Seeley et al. | |
| 7,472,758 | B1 | 1/2009 | Stevens et al. | |
| 7,969,296 | B1 * | 6/2011 | Stell | 340/522 |
| 8,230,939 | B1 * | 7/2012 | Reynolds | 169/65 |
| 2004/0145466 | A1 | 7/2004 | Anthony et al. | |
| 2009/0294141 | A1 | 12/2009 | Rouse | |

OTHER PUBLICATIONS

John Perr, Basic Acoustics and Signal Processing, http://www.ibiblio.org/pub/Linux//docs/linux-doc-project/2linuxfocus/English/March2003/article271.shtml, Feb. 28, 2003, pp. 1-20.

* cited by examiner

*Primary Examiner* — Dinh Q Nguyen
(74) *Attorney, Agent, or Firm* — Morani Patent Law, PC

(57) ABSTRACT

Stovetop fires are among the more prevalent of resident fire hazards and smoke detectors are among the most prevalent and economical forms of residential fire alarms. Automatic stovetop fire extinguishers can prevent property damage and even personal injury; however, these stovetop fire extinguishers may also limit smoke emissions and the subsequent detection of smoke. While an initial fire may be efficiently subdued by an automatic stovetop fire extinguisher, it is often desirable to alert present and future occupants of a fire hazardous condition. A sound based fire alarm system and method are described herein, which detects a sound burst emitted upon deployment of an automatic stovetop fire extinguisher and triggers a continuous fire alarm to alert occupants of a potentially fire hazardous condition. Alarm signals can be audible, visual, or both. The system may be a stand alone system and use battery power for affordability and ease of installation. The method described herein enables the ready and automatic extinguishment of a stovetop fire, while alerting those in the surrounding area or those in adjacent dwellings of a fire situation.

1 Claim, 8 Drawing Sheets

SOUND BASED FIRE ALARM SYSTEM AND METHOD

CROSS REFERENCE TO RELATED PATENTS

This application is a continuation-in-part of U.S. patent application Ser. No. 12/240,081, filed Sep. 29, 2008, which is incorporated herein by reference in its entirety.

BACKGROUND OF THE INVENTION

The present invention relates to a fire alarm system and method, and more particularly to a sound based fire detection and fire alarm system.

Conventional fire alarm systems are frequently part of a conventional home security system. Security sensors include motion detectors, while conventional fire sensors include smoke detectors and heat detectors. The home security system typically has a control panel, which receives sensor input and sends sensor commands. In addition to sensors, the home security system may comprise various warning lights, horns, bells and the like. These home fire and security systems add significant costs to the home and may be found in large homes or higher priced homes. Surveillance and monitoring service may also be incorporated into a fire and security system at an additional recurring service expense.

Conventional self contained smoke detectors are less expensive the systems referenced supra and are common in residential dwellings and may be required for insurance purposes. These battery operated units detect smoke via various means and provide a loud alert for occupants when smoke is detected. Smoke detectors are often positioned away from the cooking area to avoid nuisance alarms. Other conventional fire detectors sense heat but are less common. Commercial buildings may use self contained smoke detectors, a fire and security system, or a combination of both.

Stovetop fires, in particular, are a well known residential and commercial hazard. An unattended stovetop fire, for example a grease fire, can cause damage to nearby appliances and cabinets. Worse, stovetop fires can lead to structural damage or personal injury. Because the propensity for stovetop fires is so pervasive, an efficient means of automatic fire suppression is desired. Even if a stovetop fire is attended, an automatic extinguishing method may be more effective and expedient compared to manual means.

There are a number of conventional fire extinguishing systems, to include automatic stovetop fire extinguishers. Conventional fire extinguishers include, for example, the automatic stovetop fire extinguisher taught by Williams, U.S. Pat. No. 5,518,075. The unit can be readily mounted over a stovetop and upon detection of flames, the extinguisher releases a fire suppressant. While release of fire suppressant may extinguish a current fire, a smoke alarm, as a consequence, may not be triggered to alert occupants of the present deployment of fire suppressant and any potential for subsequent additional fires. To avoid an unwarranted smoke alarm trigger, the conventional smoke alarm in a typical residence is not placed near the cooking area. This typical proximity may decrease the likelihood of the smoke detector triggering upon activation of a distant automatic stovetop fire extinguisher.

It would be desirable to provide an automatic fire extinguisher and fire alarm system which suppressed any present flames while alerting building occupants of the hazardous situation. Depending on the applicable fire code, the building environment, and building residents themselves, a fire system may be required to have both extinguishment and alert functions. As, an example, it may desirable or required by fire codes to alert the neighboring apartments or dorm rooms of a fire hazard condition in an adjacent dwelling. For a multitude of situations, it would be desirable to provide an efficient and economical stovetop fire extinguisher and fire alert system.

SUMMARY OF THE INVENTION

The present invention provides an audible fire alarm upon deployment of an automatic fire extinguisher. Aspects of the present invention provide below are neither exhaustive nor exclusive.

An aspect of the present invention is to provide a continuing alarm in conjunction with automatic stovetop fire suppression system. Another aspect of the present invention is to provide a continuous audible alert for occupants of a dwelling or commercial building upon the automatic release of a fire suppressant and/or to provide a continuing audio signal warning those present or those subsequently entering a building of a possible fire hazardous condition.

Another aspect of the present invention is to forward the alert signal to neighbor UL rated smoke detectors, which in turn sound an alarm.

Another aspect of the present invention is to trigger a fire alarm upon sensing of a brief high decibel signal.

Another aspect of the present invention is to provide a continuous audible alarm upon activation of a STOVETOP FIRESTOP® fire suppressor (Williams-Pyro, Inc., Fort Worth, Tex., USA).

Another aspect of the present invention is upon extinguishing of a local fire, to visually notify remote occupants of the hazardous situation in the building.

Another aspect of the present invention is to interface with self-contained fire extinguishers and self-contained smoke detectors to provide a continuing audible alarm to occupants throughout a building upon the deployment of a local automatic fire extinguisher.

Another aspect of the present invention is to provide a continuous audible signal to residents of a stovetop fire condition, to include residents who are remote from the stovetop or sleeping.

Another aspect of the present invention is that it enables a sound based fire detector to be incorporated into an existing fire control system.

Another aspect of the present invention is to provide a continuing audio signal warning those present or those entering a building of a possible fire hazardous condition.

Another aspect of the present invention is to provide an affordable sound based fire alarm system, which provides a continuous audible alarm signal to alert residents of a stovetop fire condition and which operates via a self-contained power supply.

Embodiments of the present invention may employ any or all of the exemplary aspects above. Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein.

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are merely illustrative of ways to make and use the invention, and do not limit the scope of the invention.

Figure 1A:
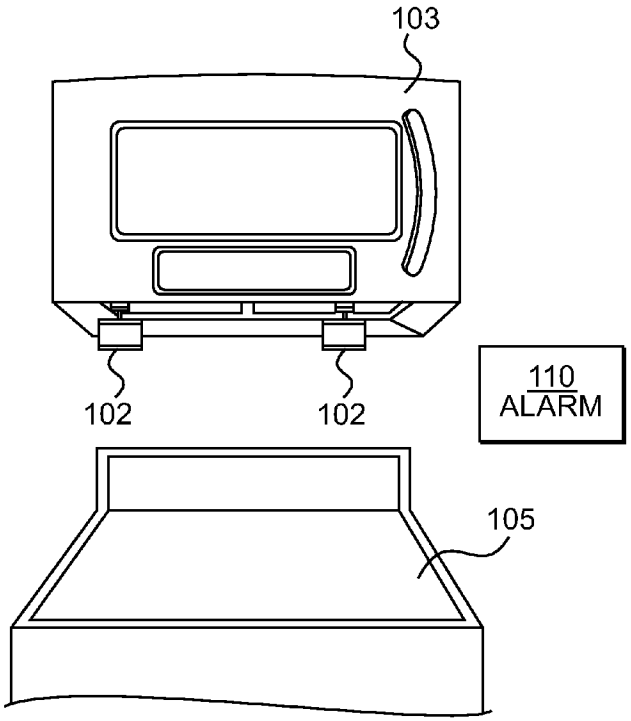
FIGS. 1A-1B shows a sound based fire alarm system employed near a stovetop and a sound based fire alarm block diagram, respectively, in accordance with an exemplary embodiment of the present invention.
Figure 1B:
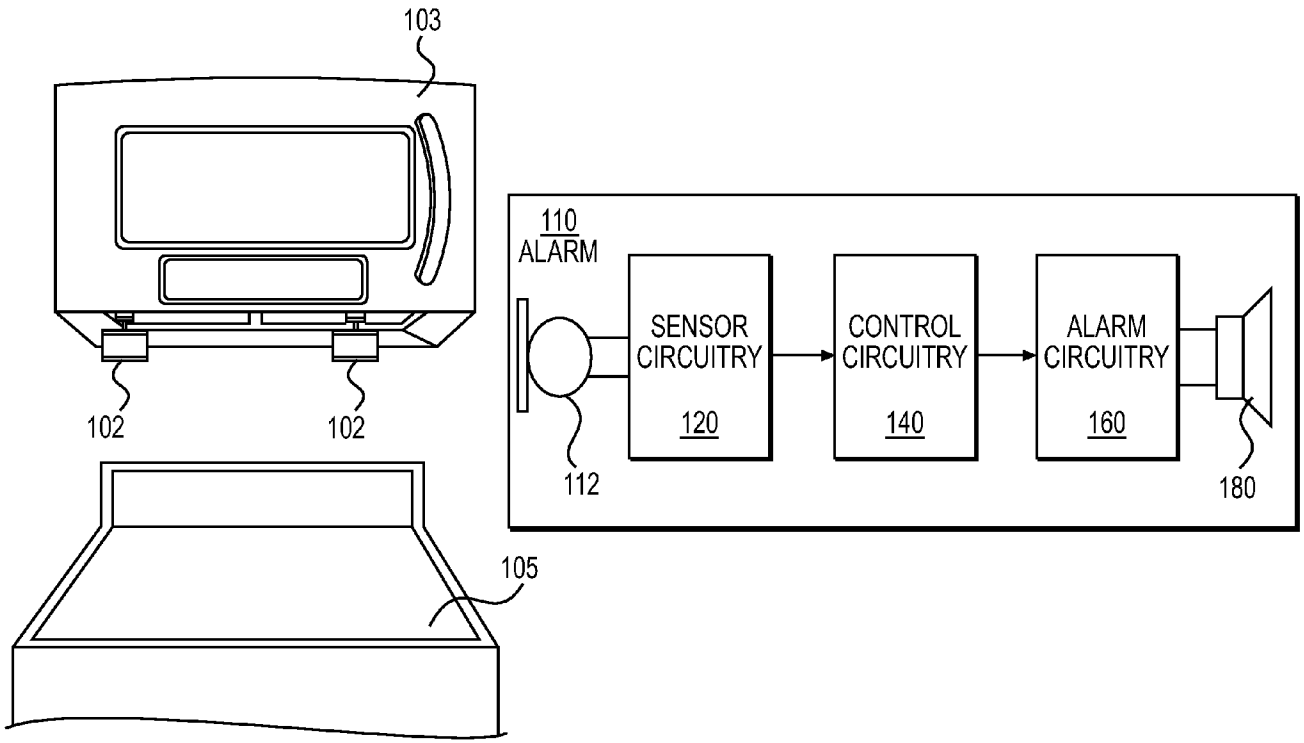

FIG. 1A shows a sound based fire alarm system employed near a stovetop, in accordance with an exemplary embodiment of the present invention. An automatic stovetop fire extinguisher 102 is mounted above a stovetop 105. Mounted on a nearby wall is a sound based fire alarm unit 110. FIG. 1B shows a block diagram of a sound based fire alarm system 110, in accordance with an embodiment of the present invention. The sound based fire alarm system 110 comprises a sensor 112, sensor circuitry 120, control circuitry 140, alarm circuitry 160, and an alarm indicator 180. In the particular embodiment of FIG. 1B, the alarm indicator 180 is provided by a speaker. Additional and/or alternative alarm indicators are discussed below with reference to FIG. 3. In accordance with embodiments of the present invention, sensor 112 is a microphone. Different embodiments of the present invention employ different microphone types. A measurement, or condenser, microphone provides an output signal corresponding to the sound pressure level of the sensed signal. The present invention may be readily employed with an automatic stovetop fire extinguisher 102, for example a STOVETOP FIRESTOP (Williams-Pyro, Inc., Fort Worth, Tex., U.S.A). As described in U.S. patent application Ser. No. 12/240,081, referenced above, a near 140 decibel burst is emitted upon ignition of the black powder substitute propellant comprised in a STOVETOP FIRESTOP fire suppressor. By placing a sound based fire alarm 110 in the vicinity of automatic fire suppressor 102, sensor 112 will sense the near 140 decibel burst if the automatic fire extinguisher deploys. Distinction of ambient sounds from the sound burst generated by the automatic stovetop fire extinguisher is performed before triggering of the sound based fire alarm, which provides a continuous alarm signal to occupants.

In an alternate embodiment a diffuse field measurement microphone, which measures sound waves from all directions, is employed as the sound sensor 112. A desirable diffuse field microphone, for use in the present invention, has a dynamic range comparable to the signature power spectral density of the fire suppressor's sound emission. According to an exemplary embodiment, the microphone has a maximum sound pressure level of at least 150 decibels and a frequency response spanning the narrow bandwidth of the fire suppressor's sound emission frequency, as shown for example in FIGS. 7A and 7B. In yet another embodiment, a near field microphone is employed in a sound based fire alarm system. Near field microphones are particularly suited for embodiments which enable mounting of the sound based alarm 110, or just the sensor 112, near the stovetop area 106, and more particularly, near the stovetop fire extinguisher 102.

Figure 2:
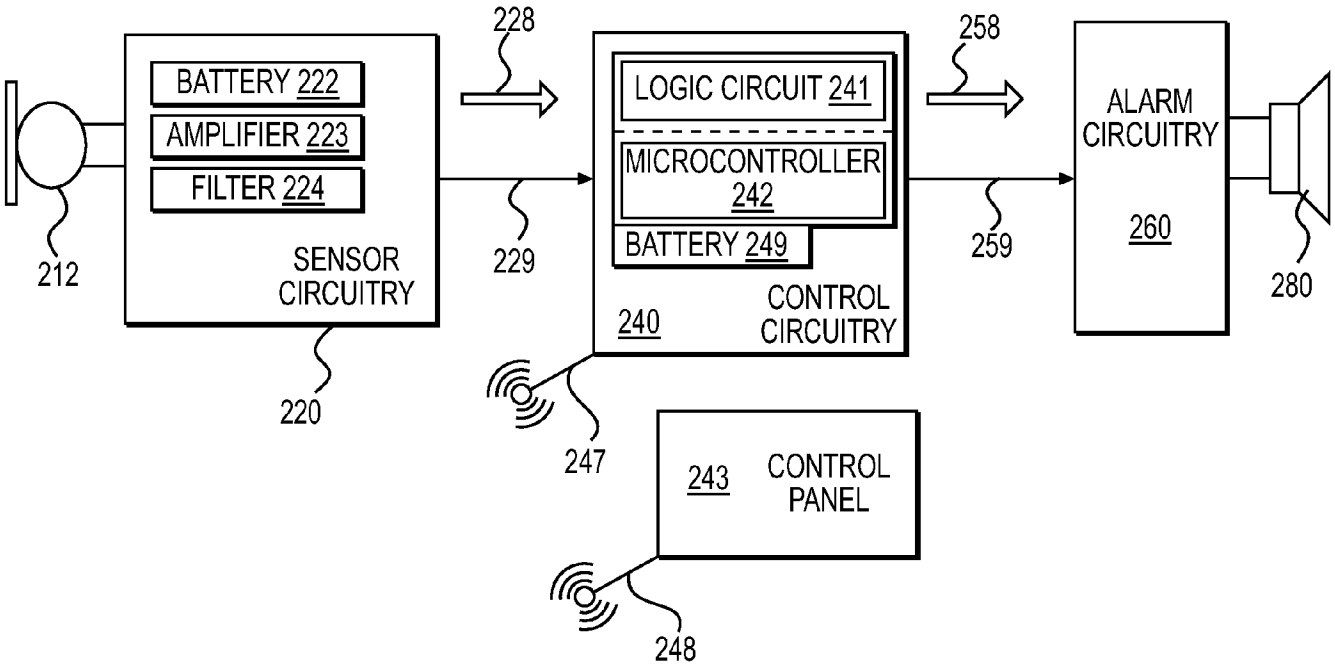
FIG. 2 shows a block diagram of a sound based fire alarm, to include inter-connections of system components, in accordance with an exemplary embodiments of the present invention.

FIG. 2 shows a block diagram of a sound based fire alarm system, in accordance with an embodiment of the present invention. Sound sensor 212, microphone, is electrically connected to sensor circuitry 220. According to the embodiment of FIG. 2, a battery power supply is provided within sensor circuitry 220. Battery power supply 222 provides a number of desirable aspects, which include a stand alone system, affordability and ready incorporation into an existing automatic stovetop fire suppression system. Sensor circuitry 220 includes a filter 224 and may include an amplifier 223. In accordance with another exemplary embodiment, sensor circuitry 220 and sensor 212 are contained in a same housing. In alternate embodiments, amplification and filtering of sound waves may be accomplished using circuitry within a microphone housing. In still another embodiment, a microphone sensor 212 is accessorized with a digital signal output proportional to a sound pressure level in decibels or nepers. The output of the sensor circuitry is electrically connected to control circuitry 240.

Figure 6:
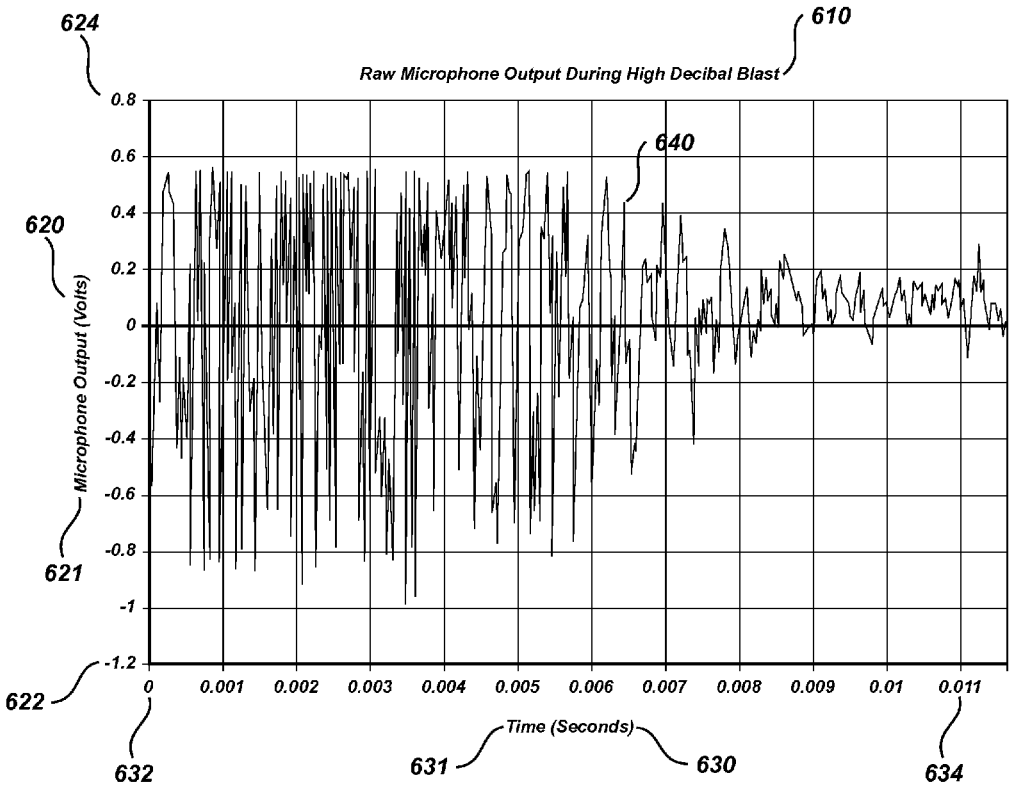
FIG. 6 shows an exemplary recording of an audible emission from an automatic stovetop fire extinguisher in accordance with the present invention.

Control circuitry 240 determines the presence of a deployed stovetop fire extinguisher from the output of the sensor circuitry 220. In accordance with an exemplary embodiment, logic circuitry 241, a microcontroller 242, or a combination of both can be used to detect the sound emission of a deployed stovetop fire extinguisher. Any of a number of signal characteristics may be assessed and compared to a threshold value corresponding to the audio signal generated upon deployment of an automatic stovetop fire extinguisher. In accordance with an exemplary embodiment, a condenser instrument microphone is mounted beneath an over the stovetop microwave 103, as shown in FIG. 1A, near an automatic stovetop fire extinguisher 102. A decibel reading in excess of 110 decibels at a frequency greater than 2.5 kHz meets threshold requirements for determination of a deployed stovetop fire extinguisher. In still another embodiment, a sound pressure level in excess of 125 decibels at any frequency for a duration of at least 5 milliseconds will exceed threshold requirements and determine the presence of a sonic signal from an activated stovetop fire extinguisher. The above sonic characteristics for determination of a deployed stovetop fire extinguisher are exemplary. These sound characteristic quantities described above, as measured near a stovetop, may avoid false determinations of an activated stovetop fire extinguisher as compared to sounds sensed from background noises.[1] A microphone signal picked up during activation of an automatic stovetop fire suppressor is shown in FIG. 6 and is further described below with reference to the same.

Referring to FIG. 2, in still other embodiments, when a control panel for a fire and security system is present, the output of the control circuitry may interface directly with an existing control panel 243. Communication 245 may be conducted, for example, by an RS485 cable. In still other embodiments, the control circuitry 240 comprises a transceiver 247, and a wireless radio frequency trigger signal is transmitted via a transceiver in the control circuitry and received at the control panel via a receiver 248, as shown for example, in FIG. 2. Control circuitry 240 can be housed within a sensor circuitry housing and may be driven from a common battery supply 222 or from its own battery supply 249.

Figure 3:
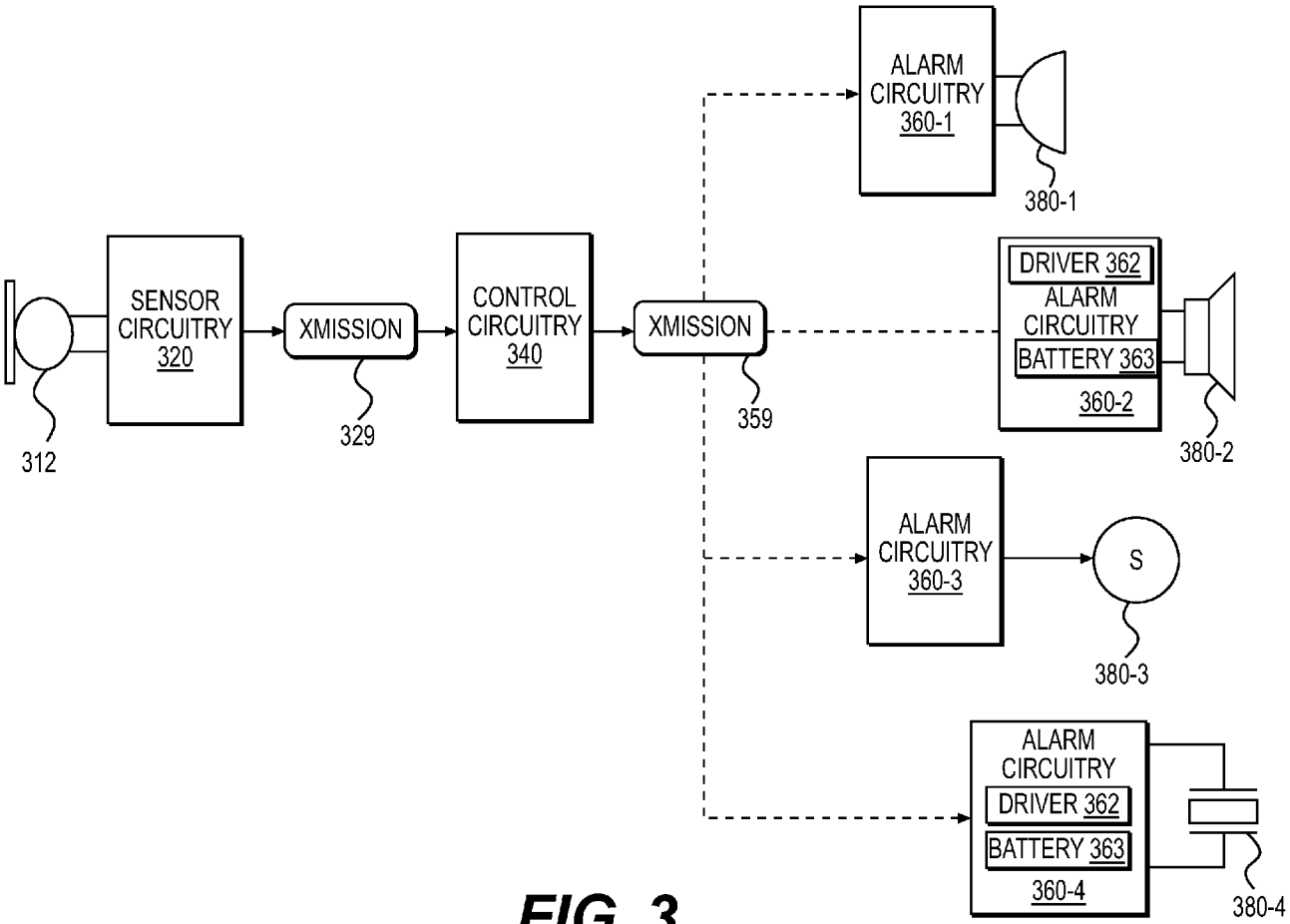
FIG. 3 shows a block diagram of a sound based audible fire alarm system employing different alarm devices, in accordance with exemplary embodiments of the present invention.

Control circuitry 240 connects to alarm circuitry 260, which in turn drives a fire alarm to generate a continuous alarm signal. FIG. 3 shows a block diagram of a sound based fire alarm with a number of alarm circuitries 360, in accordance with embodiments of the present invention. Sound sensor 312 is electrically connected to sensor circuitry 320, which connects to control circuitry 340. The output of the control circuitry 340 is electrically coupled 359 to an alarm circuitry 360-2, which in turn drives an alarm 380. Each of the circuitries, 320, 340, 360 may be housed in a same housing, in individual housings, or in some combination. Similarly the sensor 312 and alarm, for example 380, may be housed with its respective circuitry or separately, as needed or as desired. In still other embodiments at least one alarm circuitry and alarm device are remote from the control circuitry and/or the sensor circuitry. As shown in FIG. 3, the control circuitry may connect to different alarm types 380-1 to 380-4, where each alarm has its own alarm circuitry 360-1-360-4. Alarm devices may include a smoke detector 380-3, a buzzer 380-1, a piezoelectric buzzer 380-4, a speaker 380-2, or a strobe light, not shown. Each alarm circuitry may comprise a battery power supply 363 supporting an independent stand alone system. Different embodiments of a sound based fire alarm 310 may comprise any combination of alarm devices.

In accordance with one exemplary embodiment, a tone generator 362-2 provides the alarm signal which is amplified and drives speaker 380-2. A commercially available microprocessor-based digital tone generator may be employed, or a simpler transistor-transistor logic (TTL) timer-based tone generator may be employed. For some applications, such as a multi-resident or multi-dwelling building, a digital multi-tone tone generator, such as PRONOR NV's Digital Multi-tone Tone Generator V-9927A (PRONOR NV, Gent, Belgium) may be employed. In other embodiments, a sound generator integrated circuitry 363-2, an 8/10 W amplifier 364-2, and an 8 ohm speaker 380-2 can provide the alarm circuitry and alarm device, respectively.

As appreciated by one of ordinary skill, a single 9 volt battery may be used to supply 9 volts across a speaker or piezoelectric buzzer, while a diode combination or voltage regulator can drop the 9 volts to 5 or less volts across, for example, a programmable interface controller (PIC).

In still another embodiment, a smoke detector is incorporated as the alarm device 380-3. An alarm circuitry 360-3, which drives the smoke detector, will tap into the smoke detector circuitry in parallel with the smoke detection circuitry, ionizing or photoelectric, and will leave the smoke detection function intact. In alternate embodiments, the smoke detector is dedicated to the sound based fire alarm system and the smoke detection is disabled. A buzzer 380-1, or piezoelectric buzzer 380-4, may also be used as an alarm device in accordance with embodiments of the present invention. A miniature ceramic buzzer can provide 80 decibels at 10 cm, while a larger one inch diameter piezoelectric buzzer can provide 108 decibel continuous alarm at only 50 mA for voltages between 5 and 15 VDC. A piezo transducer, piezoelectric buzzer, will produce high volume when driven near its resonant frequency. A suitable driver circuitry 363 for a piezoelectric transducer 380-4 may comprise, for example, a 555 astable timer. Piezo transducers require a small current, usually less than 10 mA, so they can be connected directly to the outputs of many integrated circuitry chips, without amplification. As discussed above, alarm circuitry 360-1 to 360-4 may include a battery and may also comprise a programmable interface controller (PIC). Alarm circuitry 360-4 is shown comprising a battery 363 and a driver circuitry 362. Any and all alarm circuitries may comprise a battery and/or drive circuitry.

Figure 4:
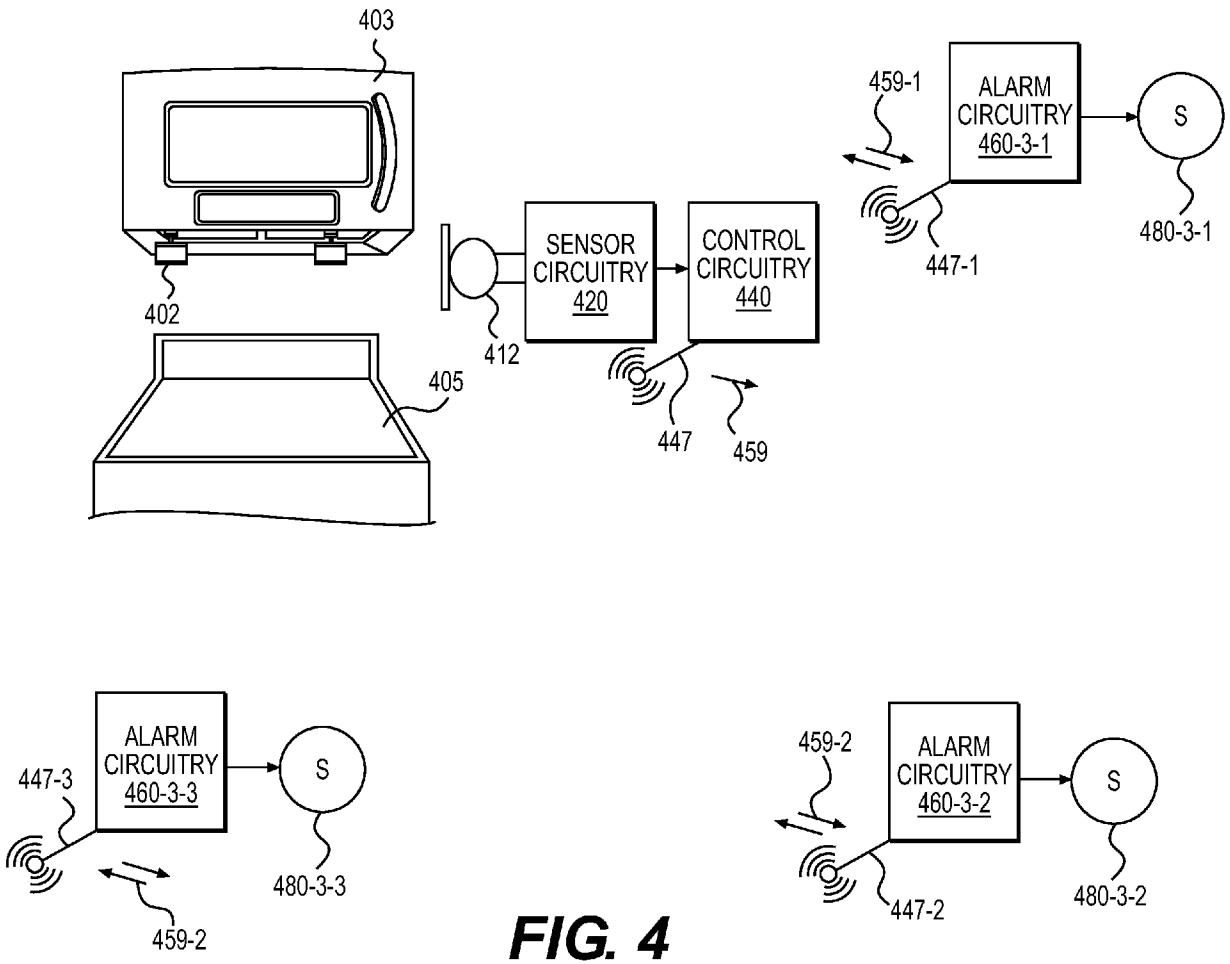
FIG. 4 shows a block diagram of a sound based audible fire alarm system incorporating communication between stand alone United Laboratories (UL) rated smoke detectors, in accordance with an embodiment of the present invention.

FIG. 4 shows a block diagram of a sound based audible fire alarm system applied in a building in accordance with an embodiment of the present invention, wherein wireless communication across UL rated stand alone smoke detectors is utilized. Sound sensor 412 senses local sounds, sensor circuitry 420 processes the received signals, and control circuitry 440 determines the presence of a deployed automatic stovetop fire extinguisher. Upon determination of a deployed stovetop fire extinguisher, a trigger signal 459 is broadcast via a wireless transmitter 447. At remote locations, antennas 447-1 to 447-3 receive the transmitted signal and activate corresponding smoke detectors 480-3-1 to 480-3-3 via respective alarm circuitries 460-3-1 to 460-3-3. The mode of communication, for example, radio frequency or Bluetooth, can vary as distance and power requirements dictate or as desired. In yet another embodiment, antenna 447 sends out a trigger signal 459 and each remote antenna 447-1, may not only receive the trigger signal but also transmit a trigger signal 459-2 for reception by additional remote smoke detectors. In the latter embodiment, alarm circuitries are modified to forward a trigger signal as well as tap into the smoke detector circuitry to activate the alarm. By hopping from smoke detector to smoke detector, a greater area can be incorporated into the sound based fire alarm system. This embodiment may be particularly well suited in a multi-dwelling setting, such as a dormitory.

Some embodiments of the present invention may be readily incorporated into an existing smoke detector system. For example, in one embodiment, an alarm circuitry may have its own housing 260 and 9 volt battery supply. Such housing may be easily mounted near a smoke detector and connections with the same easily made.

FIG. 4 shows an automatic stovetop fire suppressor 402 above a stove 405, with a sound based fire alarm nearby and smoke detectors upstairs and down the hall. More particularly a sound sensor 412, a sensor circuitry 420, and a control circuitry 440 are in proximity to the stovetop 405. Remote smoke detectors 480-3-1, 480-3-2, 480-3-3 are shown with RF transceivers and alarm circuitries 460-3-1, 460-3-2, 460-3-3 connected there to respective smoke detectors.

Figure 5:
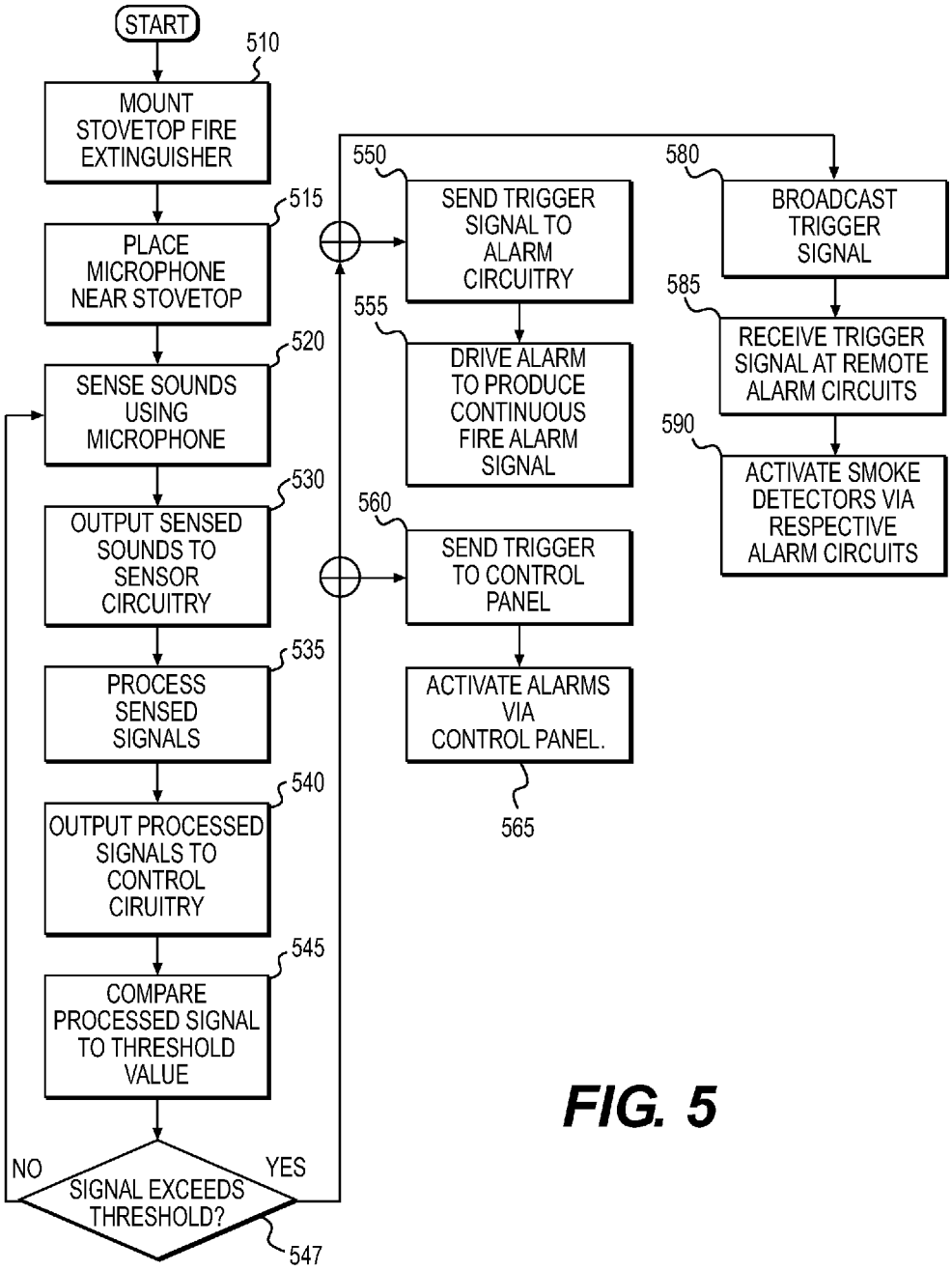
FIG. 5 shows an exemplary method of providing a sound based fire alarm system, in accordance with an embodiment of the present invention.

FIG. 5 shows an exemplary method of a sound based fire alarm, in accordance with an embodiment of the present invention. An automatic stovetop fire extinguisher, STOVETOP FIRESTOP, is mounted above a stovetop 510. A microphone is positioned in the stovetop area 515 to sense local sounds 520. Sensed signals are output to a sensor circuitry 530, which processes the sensed signals 535 by, for example high pass filtering and digitizing. Processed signals are output to a control circuitry 540. A comparison is made between attributes of processed signals and respective threshold values 545. If the signal does not exceed threshold 547, sensing of stovetop sounds continues 520. If the signal exceeds threshold values 547, which correspond to the sound burst emitted upon deployment of the stovetop fire extinguisher, then a trigger signal is sent to an alarm circuitry 550. The alarm circuitry drives the connected alarm to produce a continuous alarm signal 555.

In an alternate embodiment, if the signal exceeds threshold values 547, which correspond to the sound burst emitted upon deployment of the stovetop fire extinguisher, then a trigger signal is sent to a control panel 560. In turn, the control panel activates connected continuous alarms. In an alternate embodiment, if the signal exceeds threshold values 547, which correspond to the sound burst emitted upon deployment of the stovetop fire extinguisher, then a trigger signal is broadcast to remote alarm circuitries 580. Remote alarm circuitries receive the trigger signal 585 and activate their respective smoke detectors 590.

FIG. 6 shows a digital recording of a high decibel burst, generated upon activation of an automatic stovetop fire extinguisher, STOVETOP FIRESTOP. More particularly, FIG. 6 shows output voltage from a microphone, which is sensing the audible blast of an activating STOVETOP FIRESTOP automatic stovetop fire suppressor, as a function of time 640. Shown on the vertical axis, microphone output 621 is shown in volts 620, with time 631 on the horizontal axis in seconds 630. The vertical axis spans −1.2 to 0.8 volts 622, 624. The signal was sampled at 44.1 kHz and is shown from blast onset 632 for an 11.5 millisecond time span. The horizontal axis spans the time from blast onset, 0, 632 to just over 11 milliseconds 634. As can be seen from the recording 640, the blast drops off to one-half peak power between 6.5 and 7.5 milliseconds. The recorded signal appears to contain high frequency noise.

Figure 7A:
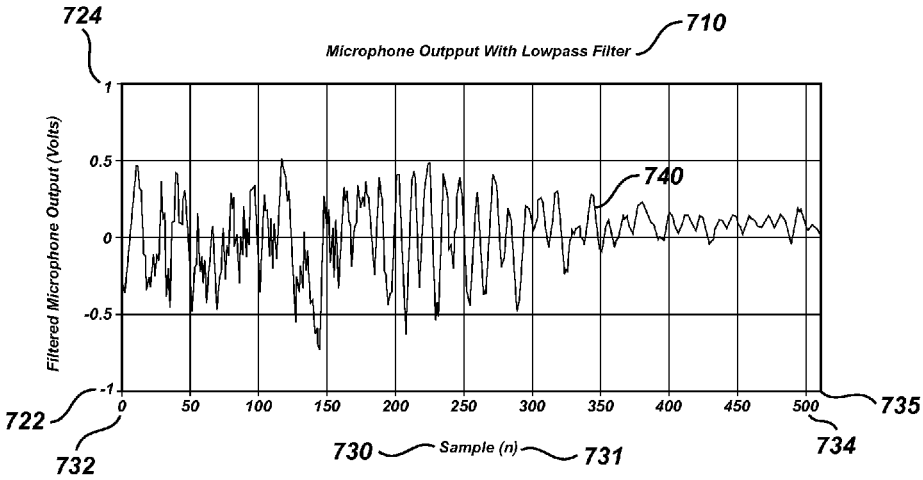
FIG. 7A shows a filtered exemplary recording of the audible emission of FIG. 6 filtered by a four point moving average to halve the noise, in accordance with the present invention.

FIG. 7A shows an exemplary recording of the audible emission of FIG. 6 filtered by a four point moving average. The raw microphone output voltage sampled at 44.1 kHz is shown filtered with a 4 point moving average, for a lowpass filtering near 5.5 kHz. Filtered microphone output 721 is shown in volts 720 as a function of sequential samples (n) 730 at a sampling rate of 44.1 kHz, every $2.27\times10^{-5}$ seconds. The time span of FIG. 7A 734 is equal to that of FIG. 6 634, with samples being taken at 44.1 kHz. Likewise the output voltage spans a similar range from −1.0 volts 722 to 1.0 volts 724. From the low pass filtered microphone output as a function of time expressed in sequential samples (n) 740, a fundamental frequency of the audible stovetop fire extinguisher blast begins to appear.

Figure 7B:
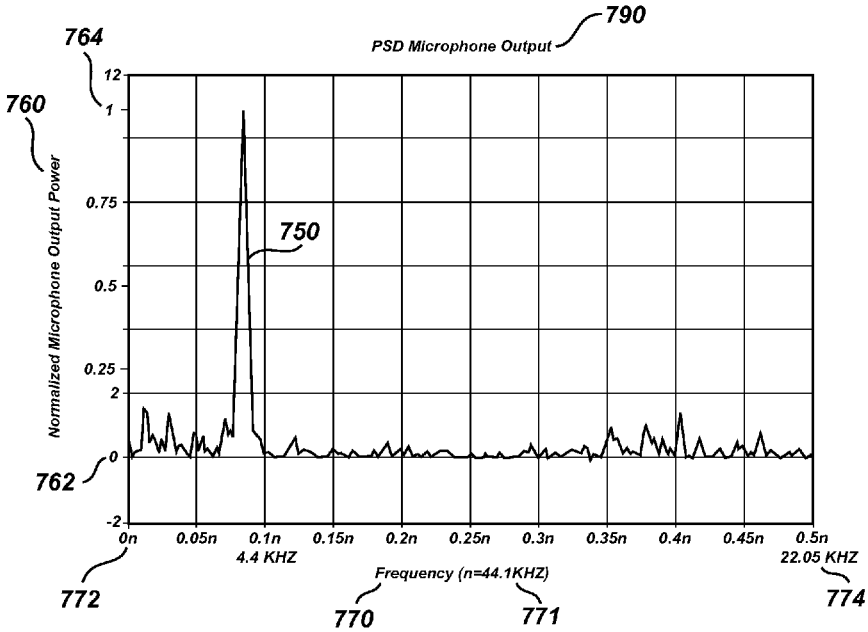
FIG. 7B shows a normalized power spectral density of a recorded audible blast from a stovetop fire extinguisher, in accordance with an exemplary embodiment of the present invention.

FIG. 7B shows a power spectral density for a recording of an audible blast of a stovetop fire extinguisher in accordance with the present invention. Using raw voltage data, FIG. 6 and a hamming window, a power spectral density was calculated and plotted. Microphone output volts squared as a function of frequency was calculated. The resulting power, volts-squared, was then normalized to a maximum of 1. The normalized power is shown as a function of frequency 750. Normalized microphone output power 760 varies from 0 762 to 1.0 764, shown on the vertical axis. Frequency, shown on the horizontal axis is shown as a decimal fraction of n, where n equals 44.1 kHz 770. The power spectrum is shown from 0 hertz, 0n, 772 to 0.5n corresponding to 22.05 kHz 774. The resulting function 750 shows the largest contribution to signal power has a bandwidth centered at approximately 3.8 kHz with a bandwidth of approximately 700 Hz. In accordance with an exemplary embodiment of the present invention, a band pass filter 224 with cutoffs at 2.5 kHz to 5.0 kHz is applied to the sensed signal in the sensor circuitry 220, shown in FIG. 2. In accordance with another exemplary embodiment, sensor circuitry 220 comprises a band pass filter with cutoffs at 3.2 kHz and 4.2 kHz. And in accordance with another embodiment, filtered signals may be amplified 222 before being output to a control circuitry 240.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiment and after consideration of the appended claims and drawing.

REFERENCE LIST

[1] Perr, J. *Basic Acoustics and Signal Processing, Sound*. http://www.linuxfocus.org/English/March2003/article271.shtml#271Ifindex3

What is claimed is:

1. A sound based fire alarm, the system comprising:

a self contained automatic stovetop fire extinguisher which emits a audible signal upon activation;

a sound burst sensor which detects audible signals and outputs a sense signal to a sensor circuitry;

wherein, the sensory circuitry processes received sensed signals and outputs processed sensed signals to a control circuitry;

wherein, the control circuitry receives processed sensed signals from the sensor circuitry, determines activation of the self contained automatic stovetop fire extinguisher, and outputs a trigger signal to an alarm system when activation of the self contained automatic stovetop fire extinguisher is determined; and wherein, the alarm system comprises an alarm circuitry and an alarm device, and wherein, when the alarm circuitry receives the trigger signal from the control circuitry, the alarm device provides a continuous fire alarm;

wherein, the sensory circuitry filters received sensed signal with a 2.5 kHz to 5.0 kHz band pass filter and outputs filtered sensed signals to the control circuitry;

wherein, the control circuitry comprises:

a digital signal processor which calculates a power spectral density via a fast fourier transform on a received sensed sound burst signal; and an integrator which integrates the power spectral density signal over 3.0 kHz to 4.0 kHz; and wherein the control circuitry compares the integrated signal to a 120 decibel value and outputs a trigger signal to the alarm circuitry when the integrated signal exceeds 120 decibels.

* * * * *